US005574823A

United States Patent [19]

Hassanein et al.

[11] Patent Number: 5,574,823

[45] Date of Patent: Nov. 12, 1996

[54] FREQUENCY SELECTIVE HARMONIC CODING

[75] Inventors: Hisham Hassanein, Kanata; André Brind'Amour, Gloucester; Karen Bryden, Ottawa, all of Canada

[73] Assignee: Her Majesty the Queen in right of Canada as represented by the Minister of Communications, Ottawa, Canada

[21] Appl. No.: 79,912

[22] Filed: Jun. 23, 1993

[51] Int. Cl.[6] ..... G10L 3/02; G10L 9/00

[52] U.S. Cl. ..... 395/2.17; 395/2.15

[58] Field of Search ..... 395/2–2.19, 2.14, 395/2.15, 2.17, 2.23, 2.31, 2.73, 2.55, 2.16, 2.17

[56] References Cited

U.S. PATENT DOCUMENTS

| | | | |
|---|---|---|---|
| 5,023,910 | 6/1991 | Thomson | 381/37 |
| 5,081,681 | 1/1992 | Hardwick et al. | 381/51 |
| 5,179,626 | 1/1993 | Thomson et al. | 395/2 |
| 5,195,166 | 3/1993 | Hardwick et al. | 395/2 |
| 5,216,747 | 6/1993 | Hardwick et al. | 395/2 |
| 5,226,108 | 7/1993 | Hardwick et al. | 395/2 |

OTHER PUBLICATIONS

A Hybrid Multiband Excitation Coder for Low Bit Rates Hassaneim et al. IEEE/25–26 Jun. 1992.

A 2400 bbs Multi–Band Excitation Vocoder Meuse IEEE/3–6 Apr. 1990.

MultiBand Excitation Vocoder Griffin et al. IEEE/Aug. 1988.

*Primary Examiner*—Allen R. MacDonald
*Assistant Examiner*—Richemond Dorvil
*Attorney, Agent, or Firm*—Pascal & Associates

[57] ABSTRACT

The present invention relates to a method of encoding speech comprised of processing the speech by harmonic coding to provide, a fundamental frequency signal, and a set of optimal harmonic amplitudes, processing the harmonic amplitudes, and the fundamental frequency signal to select a reduced number of bands, and to provide for the reduced number of bands a voiced and unvoiced decision signal, an optimal subset of magnitudes and a signal indicating the positions of the reduced number of bands, whereby the speech signal may be encoded and transmitted as the pitch signal and the signals provided for the reduced number of bands with a bandwidth that is a fraction of the bandwidth of the speech.

10 Claims, 6 Drawing Sheets

FREQUENCY SELECTIVE HARMONIC CODING

FIELD OF THE INVENTION

This invention relates to a method of digitally encoding speech whereby it can be transmitted at a low bit rate.

BACKGROUND TO THE INVENTION

Low bit rate digital speech is required where there is limited storage capacity for the speech signals, or where the transmission channels for carrying the speech signals have limited capacity such as high frequency communications, digital telephone answering machines, electronic voice mail, digital voice loggers, etc.

Two techniques that have been successful in producing reasonable quality speech at rates of approximately 4800 bits per second are referred to as Codebook Excited Linear Predictions (CELP) and Harmonic Coding, the latter defining a class which includes Multiband Excitation (MBE) and Sinusoidal Transformation Coders (STC).

A multiband excitation vocoder is described in an article by Daniel W. Griffin in IEEE Transactions on Acoustics, Speech and Signal Processing, vol. 36, no. 8, pp. 1223–1235, August, 1988.

CELP coders produce good quality speech at about 8 kbps. However as the bit rate decreases, the quality degrades gracefully. Below 4 kbps, the quality degrades more rapidly.

At low bit rates, Pitch-Excited LPC (PELP) coders operating at 2.4 kbps are currently the most widely used. However they suffer from major drawbacks such as unnatural speech quality, poor speaker recognition and sensitivity to acoustic background noise. Because of the nature of the algorithm used, the quality cannot be significantly improved.

SUMMARY OF THE PRESENT INVENTION

In the present invention, a bit rate of 2.4 kbps has been achieved, but speech quality, speaker recognition and robustness has been maintained, without significant degradation caused by acoustic background noise.

In accordance with the present invention, a combination of harmonic coding and dynamic frequency band extraction is used. In dynamic frequency band extraction, a set of windows is dynamically positioned in the spectral domain in perceptually significant regions. The remaining spectral regions are dropped. Using this technique, reasonable quality speech has been obtained at a composite bandwidth of as low as 1200 Hz, and acceptable speech quality has been obtained by encoding the resulting parameters at the rate of 2.4 kbps.

In accordance with an embodiment of the invention, a method of encoding speech is comprised of processing the speech by harmonic coding to provide, a fundamental frequency signal, and a set of optimal harmonic amplitudes of the fundamental frequency; processing the harmonic amplitudes and the fundamental frequency to select a reduced number of spectral bands and to provide for the reduced number of bands a voiced and unvoiced decision signal, an optimal subset of magnitudes and a signal indicating the positions of the reduced number of bands; whereby the speech signal may be encoded and transmitted as the pitch signal and the signals provided for the reduced number of bands with a bandwidth that is a fraction of the bandwidth of the speech.

In accordance with another embodiment, a method of encoding speech is comprised of segmenting the speech into frames each having a number of evenly spaced samples of instantaneous amplitudes thereof, determining a fundamental frequency of each frame, determining energy of the speech in each frame to provide an energy signal, windowing the speech samples, performing a spectral analysis on each of the windowed speech samples to produce a power spectrum comprised of spectral amplitudes for each frame of speech samples, calculating the positions of a set of spectral bands of each power spectrum, providing a position codebook for storing prospective positions of spectral bands, calculating an index to the position codebook from the calculated positions of the set of spectral bands of each power spectrum, calculating a voicing decision depending on the voiced or unvoiced characteristic of each of the spectral bands, vector quantizing the spectral amplitudes for each of the spectral bands, and transmitting an encoded speech signal comprising the fundamental frequency, the energy signal, the voicing decisions, the position codebook index and the vector quantized spectral amplitudes within the selected bands.

BRIEF INTRODUCTION TO THE DRAWINGS

A better understanding of the invention will be obtained by reference to the detailed description below, in conjunction with the following drawings, in which:

FIG. 1 is an overall block diagram showing the general function of the present invention, FIG. 2 is a functional block diagram of an embodiment of the encoder and transmitter portion of the present invention, FIG. 2A illustrates a representative speech spectrum before band extraction, FIG. 2B illustrates a representative speech spectrum after band extraction, FIG. 3 is a block diagram of a receiver and voice synthesizer portion of an embodiment of the invention, FIG. 4 is a drawing illustrating various frequency bands, used to explain the invention, and FIG. 5 illustrates an algorithm used to determine whether a signal is voiced or unvoiced.

DETAILED DESCRIPTION OF THE INVENTION

Figure 1:
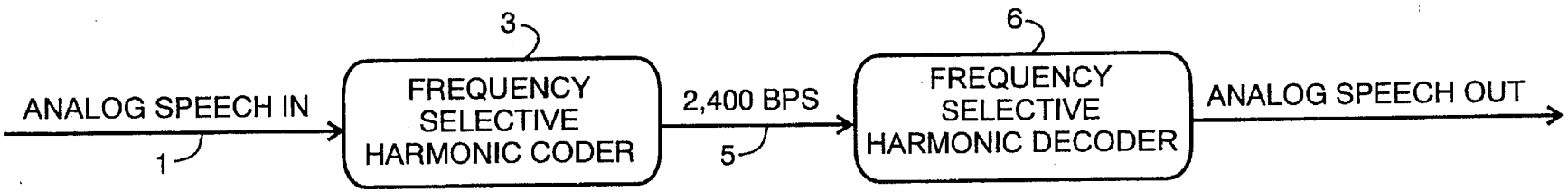

With reference to FIG. 1, analog speech received on an input channel 1 is applied to a frequency selective harmonic coder 3, operating in accordance with an embodiment of the invention. The coder preferably contains a 14 bit analog to digital converter (not shown) which samples the input signal at preferably 8,000 samples per second, and which produces a bit stream of 112,000 bits per second. That bit stream is compressed by the coder 3 to a bit rate of 2,400 bits per second, which is applied to an output channel 5. Thus the coder has achieved a significant compression of the input signal, in this case a compression factor of 46.

The bit stream is received at a frequency selective harmonic decoder 6 which converts the compressed speech to an analog signal.

Figure 2:
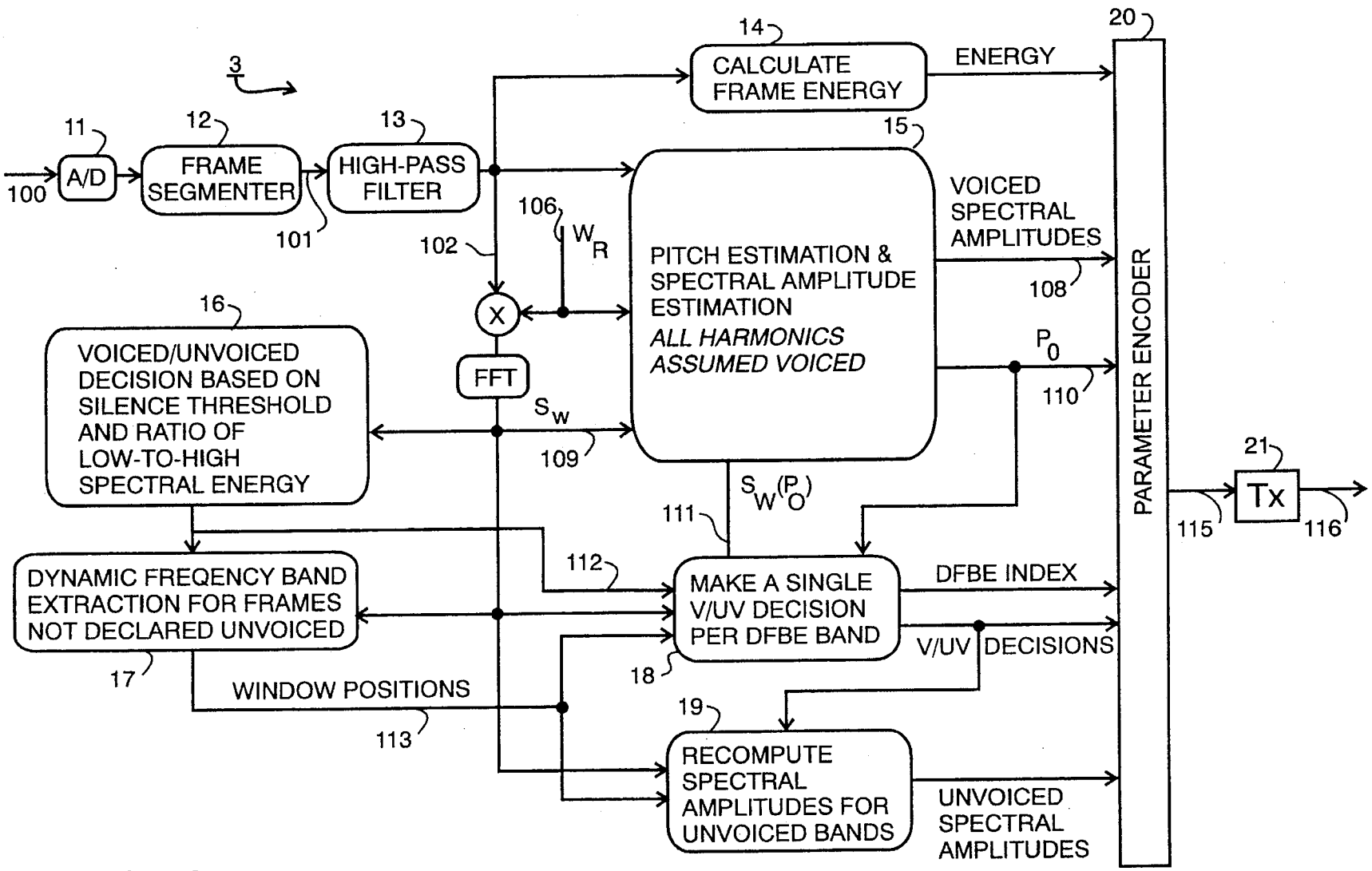

The coder 3 is shown in more detail in FIG. 2. The coder 3 is responsive to analog speech carried on channel 100 (corresponding to channel 1 in FIG. 1), to generate a bit stream of coded speech at a low bit rate (at or below 2400 bps) for transmission or storage via the channel 116 (corresponding to channel 5 in FIG. 1). Analog speech is low-pass filtered, sampled and quantitized by A/D converter 11. The speech samples are then segmented by frame segmenter 12 into frames which advantageously consist of 160 samples per frame. The resulting speech samples at 101 are then high-pass filtered by filter 13 to remove any dc bias. The high-pass filtered samples at 102 are used to calculate frame energy by element 14.

Within pitch and spectral amplitude actuator 15, the high-pass filtered samples are low pass filtered for initial pitch estimation and are windowed using window samples, $w_r$ received on line 106. The low-pass filtered samples are windowed and are processed by the pitch estimator to produce an initial pitch estimate, which advantageously uses an autocorrelation method to extract the pitch period. The initial pitch estimator 15 should attempt to preserve the pitch continuity by looking at two frames into the future and two frames from the past.

The resolution of the pitch estimate is improved from one half sample to one quarter sample. A synthetic spectrum for each of the pitch candidates as estimated. The refined pitch is that which minimizes the squared error between the synthetic spectrum it produces and the spectrum of the speech signal at 109.

The amplitudes of the synthetic spectrum are given by $$A_l(\omega_0)=\frac{\sum_{k=a_1}^{b_l-1} Sw(k)W_r(l\omega_0)}{\sum_{k=a_1}^{b_l-1} |W_r(l\omega_0)|^2}$$

where $[a_1,b_1-1]$ is a band centered around the l'th harmonic with a bandwidth equal to the candidate fundamental frequency $\omega_0$:

$$a_l=(l-0.5)\omega_0$$

$$b_l=(l-0.5)\omega_0$$

and $W_r$ at 108 is the spectrum of the refinement window.

A description of pitch estimator 15 may be found in the publications D. W. Griffin and J. S. Lim, "Multiband Excitation Vocoder", IEEE Trans on Acoust. Speech and Signal Proc., vol. ASSP-36, No. 8, pp. 1223–1235, August, 1988 and INMARSTAT M Voice Codec, August, 1991, which are incorporated herein by reference.

Figure 5:
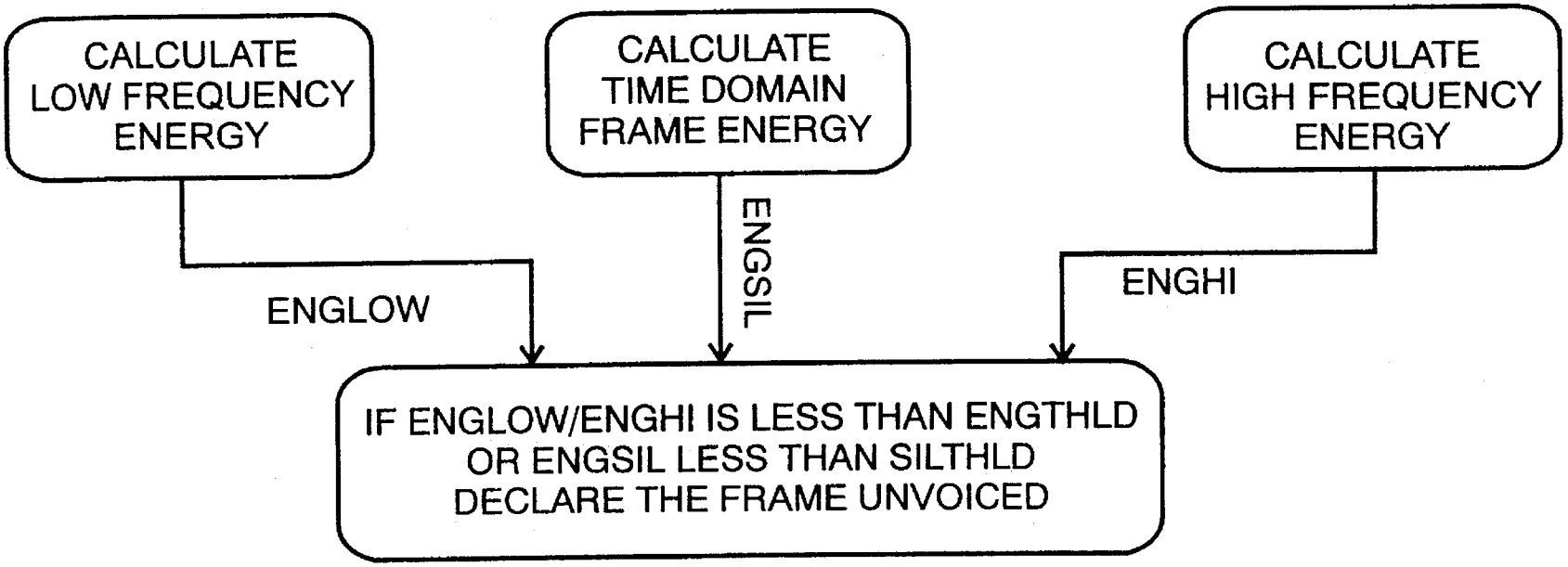

A voiced/unvoiced decision is made by element 16 for the entire frame, based on the total energy of the frame, and the ratio of low frequency to high frequency energy, as depicted by the algorithm shown in FIG. 5. If the frame energy is lower than a silence threshold SILTHLD, all harmonics are declared unvoiced. Also, if the ratio of low frequency energy to high frequency energy is less than an energy threshold ENGTHLD, all harmonics are declared unvoiced.

Figure 4:
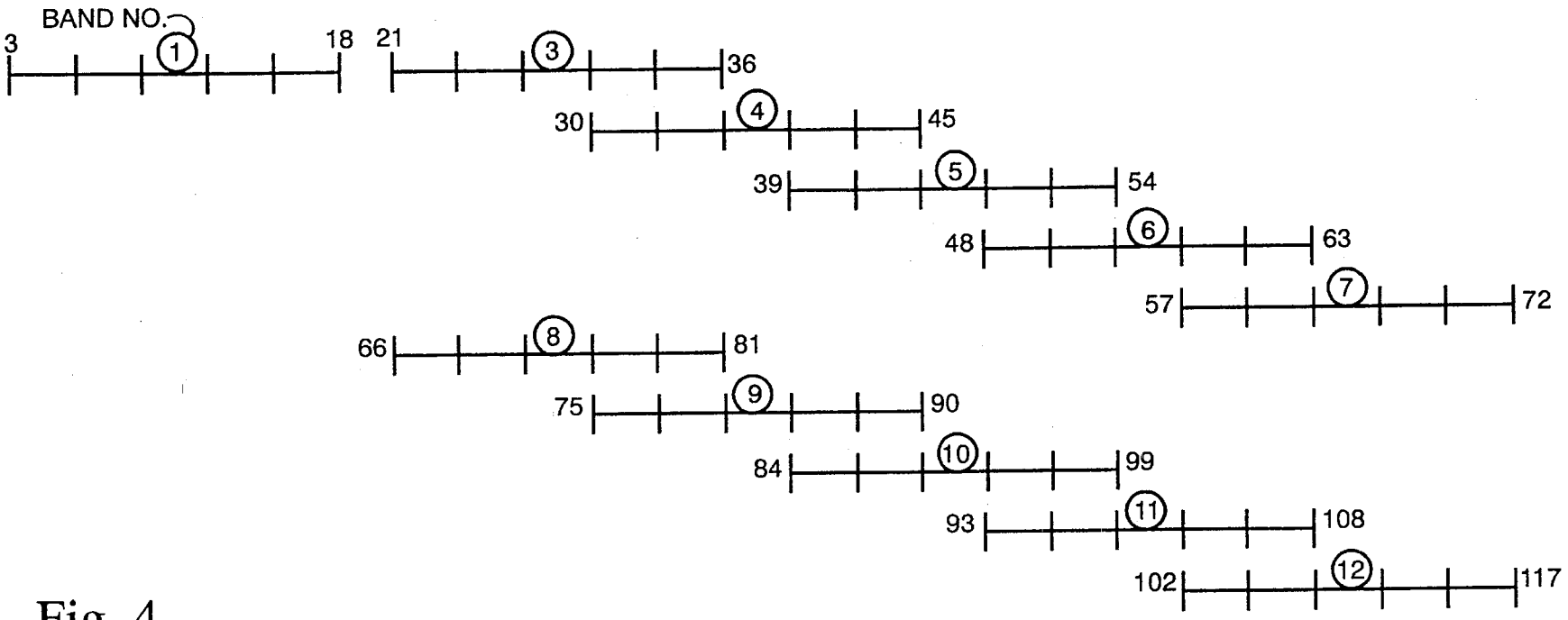

If the frame is not declared unvoiced by element 16, a dynamic frequency band extractor (DFBE), element 17, is used to select only a subset of the harmonic amplitudes for transmission, in order to reduce the required bit rate. While the selection criterion can be based on auditory perception, a criterion based on band energy is illustrated in FIG. 4, using an FFT of size 256. Band 1 and the combination of four other bands, as specified by the 32 vectors in Table 1 below and stored in a codebook are chosen so that the spectral energy within those bands is maximum. An index at 113 to the position codebook defining an optimal vector from Table 1 is used by process elements 18 and 19. Table 1 illustrates the preferred DFBE band combination in addition to band 1, which can be specified by the index.

TABLE 1

| | | | |
|---|---|---|---|
| 3,5,7,9 | 3,5,9,12 | 3,7,9,11 | 4,7,9,12 |
| 3,5,7,10 | 3,5,10,12 | 3,7,9,12 | 4,7,10,12 |
| 3,5,6,11 | 3,6,8,10 | 3,7,10,12 | 4,8,10,12 |
| 3,5,7,12 | 3,6,8,11 | 3,8,10,12 | 5,7,9,11 |
| 3,5,8,10 | 3,6,8,12 | 4,6,8,10 | 5,7,9,12 |
| 3,5,8,11 | 3,6,9,11 | 4,6,8,11 | 5,7,10,12 |
| 3,5,8,12 | 3,6,9,12, | 4,6,8,12 | 5,8,10,12 |
| 3,5,9,11 | 3,6,10,12 | 4,7,9,11 | 6,8,10,12 |

Block 18 makes a voiced unvoiced (V/UV) decision for each of the DFBE bands. The decision is based on the closeness of match between the synthetic spectrum at 111 generated by the refined pitch at 110 and the speech spectrum at 109.

Figure 2B:
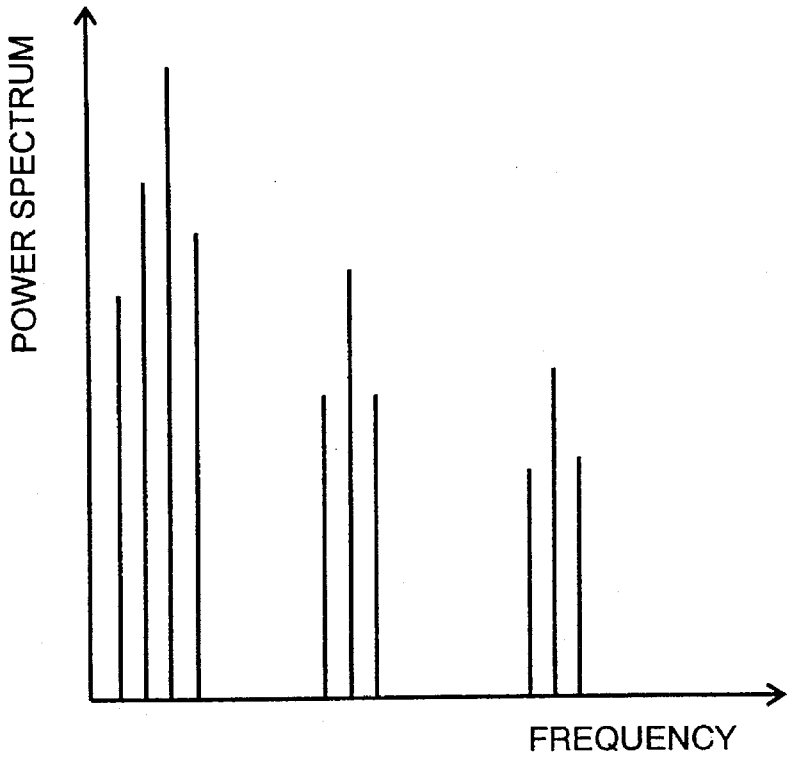
Figure 2A:
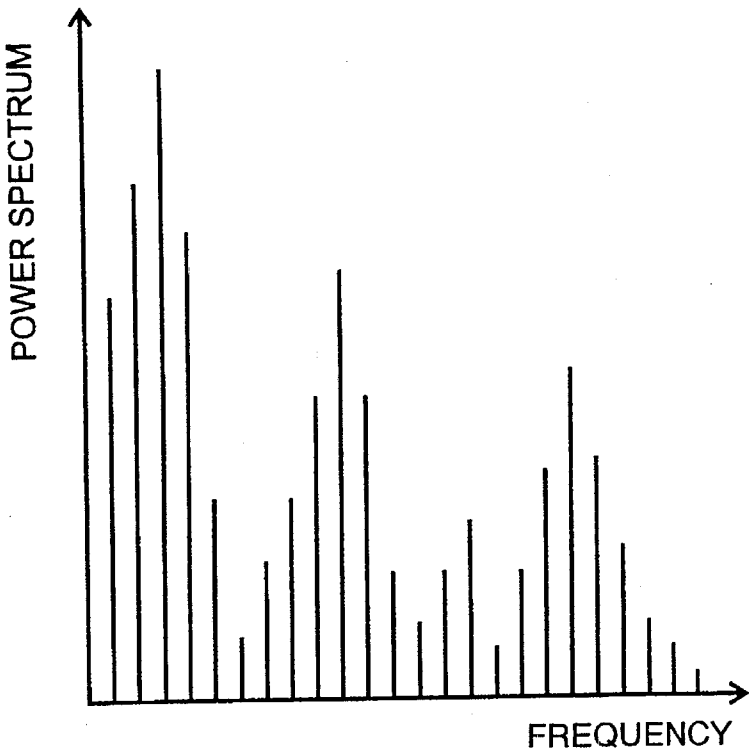

The speech spectrum before and after band extraction is shown in FIGS. 2A and 2B respectively.

Finally, process element 19 recomputes the spectral amplitudes for unvoiced harmonics, since the amplitudes generated by the synthetic spectrum at 111 are valid only for voiced harmonics. In this case, the unvoiced spectral amplitudes are simply the RMS of the power spectral lines around each harmonic frequency.

The parameter encoder process element 20 quantizes the frame energy, the pitch period and the spectral amplitudes. The DFBE band positions are represented by an index to the codebook represented by Table 1, and the V/UV decisions are quantitized at 1 bit per band. Spectral amplitudes are quantized preferably using vector quantization. Five codebooks are preferably used for frames not declared unvoiced, where an index to each codebook is chosen for each of the five DFBE bands. For unvoiced frames, two codebooks are preferably used, one for the low frequencies and another for the high frequencies. All spectral amplitudes are normalized by the frame energy prior to vector quantization. The quantized parameters are packed into the bit stream at 115 and are transmitted by the transmitter 21 via the channel 116.

In general, therefore, in order to exploit the quasi-stationarity of the speech signal, the A/D bit stream is segmented into 20 ms frames (160 samples at the sampling frequency of 8 kHz) by the frame segmenter. Each frame is analyzed to produce a set of parameters for transmission of a rate of 2400 bps.

The speech samples are high-pass filtered in order to remove any dc bias. Four sets of parameters are measured: the pitch, the voiced/unvoiced decision of the harmonics, the spectral amplitudes and the position of the amplitudes selected for quantization and transmission.

The pitch estimation algorithm is preferably a robust algorithm using analysis-by-synthesis. Because of its computational complexity, the pitch is preferably measured in two steps. First, an initial pitch estimate is performed, using a computationally efficient autocorrelation method. The speech samples are low-pass filtered and scaled by an initial window. A normalized error function, representing the difference between the energy of the low-pass filtered, windowed signal, and a weighted sum of its autocorrelations, is computed for the set {21,21.5,22,22.5, . . . , 113,113.5,114} of pitch candidates. The pitch producing the minimum error is a possible candidate. However, in order to preserve pitch continuity with past and future frames, a two-frame look-ahead and a two-frame look-back pitch tracker are used to obtain the initial pitch estimate.

The second step is the pitch refinement. Ten candidate pitch values are formed around the initial pitch estimate $P_1$. These are $$P_1-\frac{9}{8}, P_1-\frac{7}{8}, \ldots, P_1+\frac{7}{8}, P_1+\frac{9}{8}.$$

The pitch refinement improves the resolution of the pitch estimate from one half to one quarter sample. A synthetic spectrum $S_w(m,F_0)$ is generated for each candidate harmonic frequency $F_0$.

The candidate pitch minimizing the squared error between the original and synthetic spectra is selected as the refined pitch. A by-product of this process is the generation of the harmonic spectral amplitudes $A_1(F_0)$. These amplitudes are valid only under the assumption that the signal is perfectly periodic, and can be generated as a weighted sum of sine waves.

In order to decrease the number of transmitted parameters, the spectrum of frames not declared unvoiced is divided into a set of 12 overlapping bands of equal bandwidths (468.75 Hz), e.g. see FIG. 4. A combination of band 1 and a selection of a set of four non-overlapping bands {3,4, . . . , 11,12} is chosen so that the spectral energy within the selected bands is maximized.

A voiced/unvoiced decision is then performed on each of the selected bands. All harmonics located within a particular band assume the V/UV decision of that band. Since in harmonic coders, all harmonics are assumed voiced, a normalized squared error is calculated between the original and synthetic spectra, for each of the above bands. If the error exceeds a certain threshold, the model is not valid for that particular band, and all the harmonics in the band are declared unvoiced. This implies that the spectral amplitudes must be recomputed, since the original computation was based on the assumption that the harmonics are voiced. The amplitudes in this case are simply the RMS of bands of power spectral lines, each with a bandwidth of $F_0$, centered around the unvoiced harmonics.

Since the voiced/unvoiced decisions based on the harmonic model are not perfect, other criteria are added according to the algorithm shown in FIG. 5. If the frame energy is very low, the entire spectrum is declared unvoiced. Otherwise, an annoying buzz is perceived. Also, unvoiced sounds like /s/ have their energy concentrated in the high frequencies. Thus, if the ratio of low frequency energy to high frequency energy is low, all the harmonics are declared unvoiced. In this case, all the harmonic amplitudes are recomputed as above.

The harmonic amplitudes are then vector quantized. For frames declared unvoiced, two codebooks, one covering the lower part of the spectrum, and the other covering the other half, are preferably used for quantization. Otherwise, five codebooks, one for each of the selected bands, are preferably used.

Figure 3:
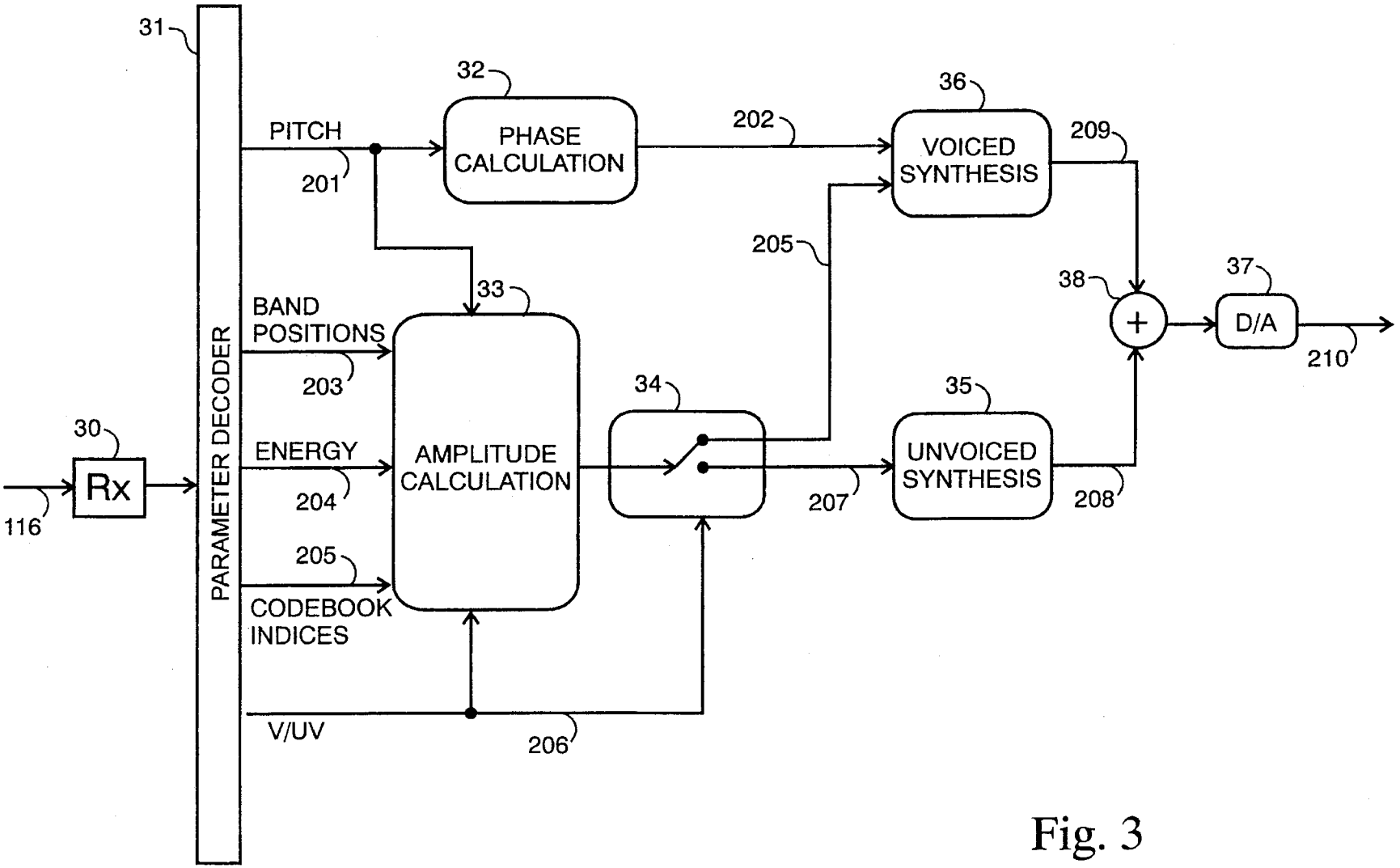

To recreate the speech, a synthesizer is used, such as shown in FIG. 3. A receiver 30 unpacks the received bit stream from 116 (assuming no errors were introduced by the channel), which is then decoded by process element 31. The synthesizer is responsive to the pitch at 201, the frequency band positions at 203, the frame energy at 204, the codebook indices at 205 and the voiced/unvoiced decisions of the frequency bands at 206. The spectral amplitudes are extracted by process element 33 from vector quantization codebooks, are scaled by the energy at 204 and are linearly interpolated. Voiced harmonic amplitudes are directed by switch 34 to a voiced synthesizer 36.

Based on the pitch at 201, block 32 calculates the harmonic phases. The voiced synthesizer 36 generates a voiced component which is presented at 209 by summing up the sinusoidal signals with the proper amplitudes and phases.

If the harmonics are unvoiced, switch 34 directs the spectral amplitudes to an unvoiced synthesis process element 35. The spectrum of normalized white noise is scaled by the unvoiced spectral amplitudes and inverse Fourier transformed to obtain an unvoiced component of the speech at 208. The voiced and unvoiced components of the speech, at 209 and 208 respectively, are added in adder 38 to produce synthesized digital speech samples which drive a D/A converter 37, to produce analog synthetic speech at 210.

The synthesizer is responsive to the fundamental frequency, frame energy, vector of selected bands, indices to codebooks of selected bands and voiced/unvoiced decisions of the selected bands to generate synthesized speech. Voiced components are generated as the sum of sine waves, with the harmonic frequencies being integer multiples of the fundamental frequency. Unvoiced components are obtained by scaling the spectrum of white noise in the unvoiced bands and performing an inverse FFT. The synthesized speech is the sum of the above voiced and unvoiced components. Advantageously, the harmonic amplitudes are interpolated linearly. Quadratic interpolation is used for the harmonic phases in order to satisfy the frame boundary conditions.

A person skilled in the art will understand that one or both of the coder and synthesizer can be realized either by hardware circuitry, computer software programs, or combinations thereof.

A person understanding this invention may now conceive of alternative structures and embodiments or variations of the above. All of those which fall within the scope of the claims appended hereto are considered to be part of the present invention.

We claim:

1. A method of encoding a speech signal comprising:

(a) processing said speech signal by harmonic coding to generate a fundamental frequency signal, and a set of optimal harmonics, (b) processing said fundamental frequency signal, and harmonics to select a number of bands encompassing a reduced number of harmonics, and to generate for each of the selected bands a voiced or unvoiced decision signal, an optimal subset of magnitudes and a signal indicating the positions of the selected bands, and transmitting a pitch signal and signals indicating the position of the selected bands with a bandwidth that contains reduced harmonics and thus is a fraction of the bandwidth of said speech signal.

2. A method of encoding speech comprising:

(a) segmenting the speech into frames each having a number of evenly spaced samples of instantaneous amplitudes thereof, (b) determining a fundamental frequency of each frame, (c) determining energy of the speech in each frame and generating an energy signal, (d) windowing the speech samples, (e) performing a spectral analysis on each of the windowed speech frames to produce a power spectrum comprised of spectral amplitudes for each frame of speech samples, (f) calculating the positions of a set of spectral bands of each power spectrum which encompasses a reduced number of harmonics, (g) storing in position codebook prospective positions of spectral bands, (h) calculating an index to the position codebook from the calculated positions of said set of spectral bands of each power spectrum, (i) calculating a voicing decision for each of said spectral bands depending on the voiced or unvoiced characteristic of each of said spectral bands, (j) vector quantizing the spectral amplitudes for each said spectral bands encompassing a reduced number of harmonics, and (k) transmitting an encoded speech signal comprising said fundamental frequency, said energy signal, said voicing decisions, said position codebook index, and indices to the vector codebook.

3. A method as defined in claim 2 including passing said frames through a high pass filter immediately after segmenting the speech into said frames in order to remove any d.c. bias therein.

4. A method as defined in claim 3 in which the step of calculating a voicing decision is effected by determining the total frame energy and declaring the frame as unvoiced if the frame energy is lower than a predetermined silence threshold.

5. A method as defined in claim 3 in which the step of calculating a voicing decision is effected by determining the ratio of total low frequency energy to total high frequency energy in a frame and declaring the frame as unvoiced if the ratio is less than a predetermined threshold.

6. A method as defined in claim 2 in which the step of calculating the position of a set of said spectral bands is comprised of selecting a combination of bands containing maximum energy.

7. A method as defined in claim 2 in which the step of calculating the position of a set of said spectral bands is comprised of selecting a combination of bands based on an auditory model for the determination of perceptual thresholds.

8. A method as defined in claim 2 in which the step of vector quantizing the harmonic amplitudes is comprised of calculating an error between harmonic amplitudes within each of the spectral bands and elements of each of vectors stored in the amplitude codebooks, and selecting the index by minimizing said error.

9. A method as defined in claim 2 in which the step of calculating a voicing decision is effected by determining the total frame energy and declaring the frame as unvoiced if the frame energy is lower than a predetermined silence threshold.

10. A method as defined in claim 2 in which the step of calculating a voicing decision is also effected by determining the ratio of total low frequency energy to total high frequency energy in a frame and declaring the frame as unvoiced if the ratio is less than a predetermined threshold.

* * * * *